United States Patent [19]

Harwood, Jr. et al.

[11] Patent Number: 4,879,996

[45] Date of Patent: Nov. 14, 1989

[54] CLOSED CIRCUIT BREATHING APPARATUS

[76] Inventors: Van H. Harwood, Jr., 46 Hunter Lane, Williamsville, N.Y. 14221; Jeffrey J. Dosch, 147 University Ave., Buffalo, N.Y. 14214, Loyal G. Netteland, 108-1 Wimbledon Ct., West Seneca N.Y. 14224

[21] Appl. No.: 2,877

[22] Filed: Jan. 13, 1987

[51] Int. Cl.[4] ..... A62B 7/08

[52] U.S. Cl. ..... 128/202.26; 128/202.27; 128/204.75; 128/205.12; 128/205.17; 128/205.24

[58] Field of Search ..... 128/202.26, 202.27, 128/204.25, 205.12, 205.13, 205.16, 205.17, 205.23, 205.24

[56] References Cited

U.S. PATENT DOCUMENTS

| | | | |
|---|---|---|---|
| 693,795 | 2/1902 | Giersberg . | |
| 2,106,393 | 1/1938 | Hausmann . | |
| 2,507,450 | 5/1950 | Millikan et al. . | |
| 2,598,525 | 5/1952 | Fox . | |
| 3,292,617 | 12/1966 | McDonough . | |
| 3,577,988 | 5/1971 | Jones . | |
| 3,773,044 | 11/1973 | Wallace . | |
| 3,815,592 | 6/1974 | Staub, Jr. . | |
| 3,837,337 | 9/1974 | LaViolette . | |
| 3,863,629 | 2/1975 | Ries . | |
| 3,913,576 | 10/1975 | Martin et al. . | |
| 3,957,044 | 5/1976 | Fletcher et al. . | |
| 3,993,059 | 11/1976 | Sjostrand . | |
| 4,031,887 | 6/1977 | Botos et al. . | |
| 4,060,076 | 11/1977 | Botos et al. . | |
| 4,108,171 | 8/1978 | Nyman et al. . | |
| 4,141,353 | 2/1979 | Dahlback et al. . | |
| 4,154,234 | 5/1979 | Baker . | |
| 4,159,236 | 5/1979 | Eckstein et al. | 128/202.26 |
| 4,163,448 | 8/1979 | Grouard . | |
| 4,252,114 | 2/1981 | Seres et al. . | |
| 4,567,889 | 2/1986 | Lehmann . | |

FOREIGN PATENT DOCUMENTS

| | | | |
|---|---|---|---|
| 208565 | 4/1909 | Fed. Rep. of Germany | 128/205.12 |
| 241647 | 12/1911 | Fed. Rep. of Germany | 128/205.12 |
| 2254181 | 7/1975 | France | 12/202.26 |
| 992248 | 5/1965 | United Kingdom . | |

OTHER PUBLICATIONS

Brochure—"Emergency Escape Breathing Device", Scott Aviation, Lancaster, New York, published at least as early as Jan. 1983.

*Primary Examiner*—Max Hindenburg
*Assistant Examiner*—K. M. Reichle
*Attorney, Agent, or Firm*—Christel, Bean & Linihan

[57] ABSTRACT

A closed circuit breathing apparatus such as that worn by personnel in irrespirable atmospheres. The apparatus is mounted on a backframe and housing 14 and is adapted to be interconnected with a face mask 12. The apparatus includes exhalation and inhalation passageways 18, 20, a source of breathing gas 50 which is released into the breathing apparatus at a constant volumetric flow rate, a carbon dioxide scrubber 38 and an ejector pump 40 which is driven by the source of pressurized breathing gas and which causes the pressurized breathing gas and exhaled air to be driven through the carbon dioxide scrubber at a relatively constant flow rate. The apparatus further includes a spring biased inhalation gas accumulator or counterlung 46 on the downstream side of the carbon dioxide scrubber, which counterlung is in communication with the inhalation passageway. An exhalation gas accumulator 42 is provided on the upstream side of the carbon dioxide scrubber, the exhalation gas accumulator being in communication with the exhalation passageway. The exhalation and inhalation gas accumulators are in fluid communication with each other so that at extremely high breathing rates exhaled gases can flow from one to the other whereby all system gases will be held at the same pressure. A warning device 78, 80 is provided, as well as a redundant circuit.

20 Claims, 2 Drawing Sheets

Fig. 1.
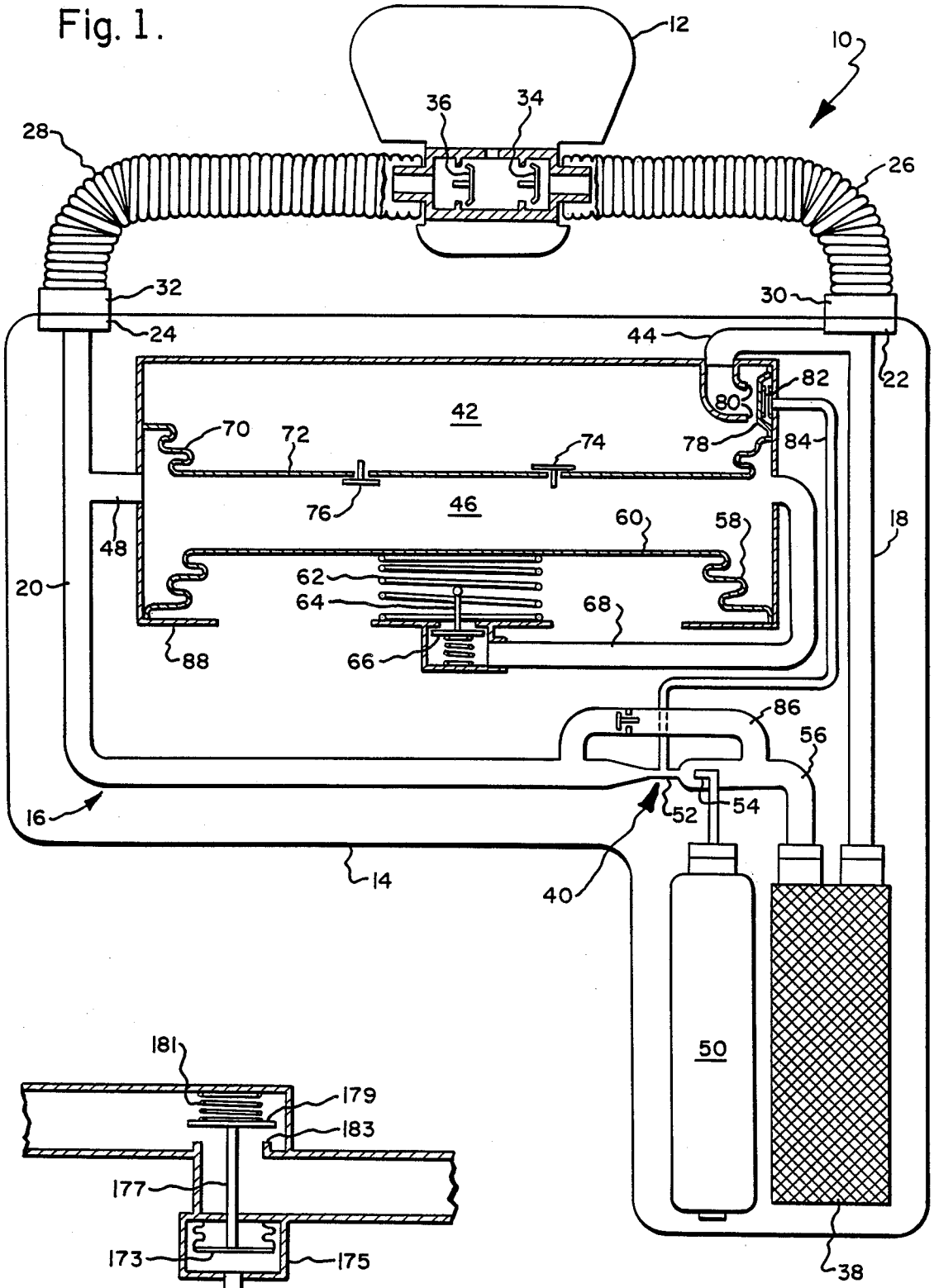
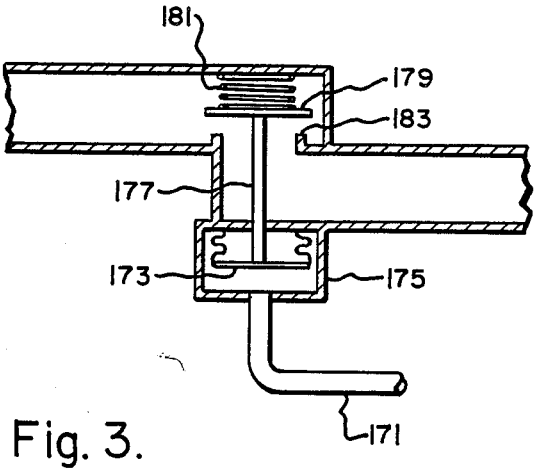
Fig. 3.

CLOSED CIRCUIT BREATHING APPARATUS

TECHNICAL FIELD

The present invention relates generally to a single person portable closed circuit breathing apparatus such as that worn in irrespirable atmospheres, and more particularly, to a closed circuit breathing apparatus including a closed gas circulating circuit wherein all gases within the circuit are held at the same pressure, the circuit including inhalation and exhalation passageways leading to and from a face mask, respectively, an exhalation gas accumulator, a carbon dioxide scrubber, a counterlung or inhalation gas accumulator and pump means associated with a source of make-up gas and capable of causing expired gases to be pumped through the carbon dioxide scrubber at a relatively constant volumetric flow rate.

BACKGROUND OF THE INVENTION

Closed circuit breathing apparatus which is adapted to be worn on the back (or front) of the user is well known in the prior art and typical examples are U.S. Pat. Nos. 3,863,629; 4,567,889 and U.K. Pat. No. 992,428. This apparatus may typically be worn by personnel fighting fires, although it has many other applications. In a closed circuit apparatus the user recycles his exhalation gas after the carbon dioxide has been removed and the oxygen consumed by the user has been made up. Thus, in the prior art devices referred to, there is a closed gas circulating circuit including a carbon dioxide absorber or scrubber, and a face mask which is interconnected with the CO2 scrubber by inhalation and exhalation tubes or passageways, these tubes being provided with suitable check valves. It is also a feature of the above prior art to provide a make-up source of breathing gases, typically pure oxygen, as well as a counterlung or the equivalent in the form of a breathing bag in which purified gases are stored prior to inhalation so that the wearer of the apparatus will typically have sufficient purified gases for all but the largest inhalations.

As face mask seals sometimes leak it is frequently desirable to provide a positive pressure system so that if there is leakage about the face mask seal, irrespirable gases will not be inhaled. This is typically done by providing a positive pressure to the counterlung as taught in U.S. Pat. No. 4,567,889.

While the above devices apparently perform in a satisfactory manner for their intended purposes, such devices require the wearer to exert greater inhalation and exhalation efforts than he would normally be required in an open atmosphere. While such increased breathing effort cannot be totally eliminated, it is desirable to minimize the increased effort as much as possible. Thus, by providing a counterlung on the downstream side of the carbon dioxide scrubber, inhalation effort is typically reduced to an acceptable level to the extent that a sufficient volume of breathable gases are contained in the counterlung. However, if this is not the case, and if it is then necessary to draw upon the breathable gases being processed through the carbon dioxide scrubber, the inhalation effort will substantially increase. In order to reduce exhalation breathing resistance it has been proposed to utilize an ejector pump to assist the user's respiration by pumping exhaled gas through the scrubber at a relatively constant volumetric flow rate, and this design feature is also shown in U.S. Pat. No. 4,567,889. However, at exhalation rates greater than the flow rate of the pump, increased breathing resistance is still encountered up to the limit established by an overpressure valve.

U.S. Pat. No. 3,815,592 shows breathing bags to either side of a carbon dioxide absorber and source of oxygen. In this device the pressure in the exhalation side of the circuit is greater than the pressure in the inhalation side, leading to greater exhalation effort at all times. In addition, if the inhalation accumulator cannot supply all the needed gas during inhalation, substantially increased inhalation effort will be encountered.

U.S. Pat. No. 2,106,393 discloses an emergency breathing apparatus having a common inhalation-exhalation breathing bag. While this form of device will have a lower breathing resistance, it will accumulate excessive carbon dioxide.

OBJECTS AND SUMMARY OF THE INVENTION

It is a principal object of the present invention to provide a closed circuit breathing apparatus having low inhalation and exhalation breathing resistance at all work rates, and which will also have a relatively low percentage of carbon dioxide in the inspiratory air.

It is a further object of the present invention to provide a pressurized closed circuit breathing apparatus having low breathing resistance at all work rates.

It is a further object of the present invention to provide a pressurized closed circuit breathing apparatus having all system gases held at the same pressure.

It is a further object of the present invention to provide a closed circuit breathing apparatus having high reliability due to redundancy.

It is a further object of the present invention to provide a closed circuit breathing apparatus having a redundant circuit and warning device which will indicate to the user when it is desirable to switch to the redundant circuit.

It is a further object of the present invention to provide an apparatus of the type set forth above wherein an ejector pump is utilized to assist the user's respiration by pumping exhaled gas through the scrubber.

The above objects and other objects and advantages of this invention are accomplished by providing a closed circuit breathing apparatus adapted to be interconnected with a face mask by suitable inhalation and exhalation conduits provided with suitable check valves, the closed circuit breathing apparatus including exhalation and inhalation passageways, a source of breathing gas which is released into the breathing apparatus at a constant flow rate, a carbon dioxide scrubber, an ejector pump driven by the source of pressurized breathing gas which causes the pressurized breathing gas and exhaled air to be driven through the carbon dioxide scrubber at a relatively constant flow rate, an inhalation gas accumulator or counterlung on the downstream side of the carbon dioxide scrubber which is in communication with the inhalation passageway, and an exhalation gas accumulator on the upstream side of the carbon dioxide scrubber and which is in communication with the exhalation passageway, the exhalation gas accumulator and counterlung being in fluid communication with each other so that at extremely high breathing cycle rates, exhaled gases can flow directly to the counterlung and at extremely low breathing rates, scrubbed gases can flow from the counterlung to the accumulator whereby all system gases will be held at the same pressure. Additionally, a redundant source of breathing gas, carbon dioxide scrubber, and ejector pump are provided so that when either the first source of breathing gas is exhausted, or if there is a high flow resistance through the first circuit, the operator can initiate the operation of the second source of oxygen. Additionally, a warning device which increases breathing effort is provided so that the operaor will know when it is time to switch to the redundant circuit.

The foregoing objects and advantages of this invention will be more fully understood from a consideration of the following detailed description taken in conjunction with the accompanying drawings in which a preferred form of this invention is illustrated.

BRIEF DESCRIPTION OF THE DRAWINGS

FIG. 1 is a schematic diagram illustrating a first embodiment of this invention.

FIG. 3 is a view illustrating an alarm valve which is pressure operated.

DETAILED DESCRIPTION

Figure 2:
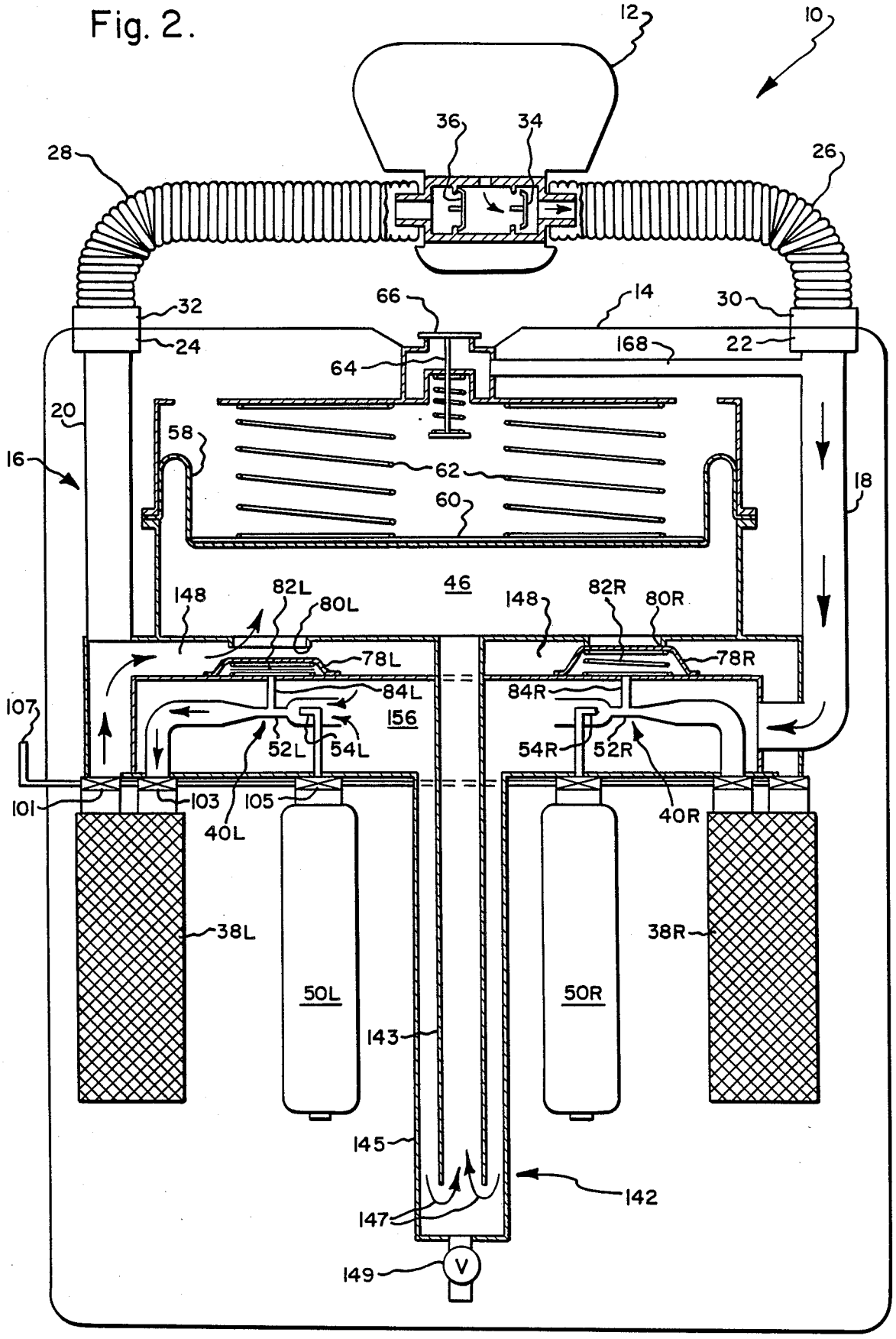
FIG. 2 is an illustration of a preferred embodiment of this invention, the various parts being shown at the start of an exhalation.

Referring first to FIG. 1, the single person portable closed circuit breathing apparatus of this invention is indicated generally by reference numeral 10. This apparatus includes a face mask 12 which may be of any suitable construction and a back frame and housing 14 which supports gas circulating circuit means indicated generally at 16. The gas circulating circuit means includes exhalation passageway means 18 and inhalation gas passageway means 20. These passageway means are provided with suitable exhalation and inhalation ports 22, 24, respectively, which in turn may be connected to suitable inhalation and exhalation conduits 26, 28, respectively by suitable exhalation and inhalation couplings 30, 32. The conduits 26 and 28 can be considered to be part of the passageway means 18 and 20 for functional purposes and the passageway means are provided with suitable exhalation and inhalation check valves, 34, 36. These check valves are preferably disposed at the terminal ends of conduits 26, 28 adjacent the mask 12. These check valves perform in a manner well known in the art and thus when the wearer of the face mask 12 exhales, the exhalation check valve 34 will be caused to be opened and the inhalation check valve 36 will be caused to be closed. Similarly, when the wearer of the mask 12 inhales the inhalation check valve 36 will be caused to be opened and the exhalation check valve 34 will be caused to be closed.

The gas circulating circuit means 16 includes, in addition to the passageway means 18 and 20, a carbon dioxide absorber or scrubber 38 and a pump 40 in circuit with the carbon dioxide absorber and capable of forcing exhaled gases through the carbon dioxide absorber at a relatively constant volumetric rate. The scrubber may be a canister containing soda lime. In the embodiment of FIG. 1, the pump 40 is disposed downstream of the carbon dioxide scrubber. The gas circulating means 16 in addition includes an exhalation gas accumulator 42, which is in fluid communication with the exhalation gas passageway 18 by means of branch circuit 44, and an inhalation gas accumulator 46, which is in communication with the inhalation gas passageway 20 by means of a further branch circuit 48. Connected to the gas circulating means 16 is a source of makeup oxygen which can be a bottle of compressed oxygen but which is preferably a chlorate candle 50. The pump means 40 is of the type referred to in the art as an ejector pump which includes a venturi 52. The gas from the chlorate candle is discharged through a jet orifice 54 at a relatively constant rate and it causes gas in the passageway 56 to be entrained with the oxygen discharged through the orifice and to be forced through the venturi at a relatively high velocity. As the gas in the passageway 56 adjacent the venturi will have a lower pressure than the gas in the exhalation gas passageway means 18 (which is at the same pressure as the gas in the inhalation gas passageway means 20), the exhalation gases in the passageway 18 will be forced through the scrubber 38 at a relatively constant rate proportionate to the discharge of the chlorate candle 50. The parts are so sized that a desired volumetric flow rate of somewhere between 40–50 liters per minute is achieved through the scrubber 38.

The inhalation gas accumulator 46 is frequently referred to in the art as a counterlung and it includes a bellows 58 and a plate 60. The accumulator is spring loaded by a spring 62 which will engage plate 60 and normally bias the accumulator towards an empty position. By spring loading the inhalation gas accumulator the gases within the entire gas circulating circuit means 16 and mask 12 are caused to be at a pressure above ambient thereby preventing the intrusion of ambient gases into the system.

When the accumulator moves to a full position the stem 64 of a relief valve 65 will be contacted by the plate 60 permitting excess gas to be discharged from the accumulator 46 through passageway 68, relief valve 66 and then about the spring 62 to atmosphere.

The operation of the apparatus so far described in FIG. 1 will be as follows: When the chlorate candle 50 is in operation and the wearer of the mask 12 initially starts to exhale, exhaled gases will be forced through conduit 26 the exhalation gas passageway 26, 18. If the volumetric flow rate of exhalation is greater than the normal volumetric flow rate through the scrubber 38, only that portion of the exhaled gases which can be accommodated by the scrubber will pass through the scrubber and the balance of the exhaled gases will move into the exhalation accumulator 42. The accumulator includes bellows 70, plate 72 and inlet and outlet check valves 74, 76, respectively. The accumulator 42 will expand during higher than normal exhalation rates, although in normal operation it may not reach its fully expanded position. In the meantime, during the exhalation period, the counterlung 46 will also expand as the makeup oxygen and exhalation gases enter the system. Towards the end of the exhalation effort, at normal work rates, the volumetric flow rate of the exhaled gases will decrease below that volumetric flow rate which is pumped through the scrubber 38 by the pump 40 and therefore all of the exhaled gases will pass through the exhalation gas passageway to the scrubber 38 and additional gases will be drawn from the exhalation gas accumulator 42 to maintain the constant flow rate through the scrubber. At the start of an inhalation effort, gas will be drawn from the inhalation gas accumulator 46 as well as that gas being discharged by the pump causing the volume of the accumulator 46 to decrease. Meanwhile additional exhalation gases, which have been stored in the exhalation gas accumulator are still being processed by the pump and scrubber 38. During inhalation in the event that there are not sufficient gases in the exhalation accumulator 42 to be processed by the scrubber 38 and pump 40, the check valve 74 will open to satisfy pump demand and maintain constant system pressure. Also, in the event the exhalation accumulator 42 becomes loaded to its capacity, the check valve 76 will open discharging excess exhaled gases into the inhalation accumulator 46, again maintaining constant system pressure. Similarly, if the exhalation accumulator becomes fully discharged, the check valve 74 may open.

By utilizing the combination of the inhalation and exhalation accumulators which are in fluid communication with each other, the exhaled gases can be processed through the scrubber at a constant rate throughout the user's breathing cycle, and in addition all gases within the system (with the exception of those gases in the immediate vicinity of the pump) can be held at the same pressure thereby minimizing inhalation and exhalation effort. Because of these features, the pump then does not have to keep up with exhalation peaks allowing the use of a smaller pump with a lower pumping rate than would be required if such an exhalation gas accumulator did not exist. In addition, because the ejector pump 40 pumps gas at a constant rate which is less than peak respiratory rates, a smaller and more efficient carbon dioxide scrubber can be used.

A few points about the operation of the breathing apparatus should be noted. At levels of activity up to a moderately heavy work rate (a work rate corresponding to a ventilation of 50 liters per minute), the system is so designed that there is no carbon dioxide in the inhaled gas (measured in the inhalation conduit 28 before mixing in the mask). At heavier work rates, which may be encountered for short periods of time, a certain percentage of carbon dioxide will be detected in the inhaled gas. The carbon dioxide can be detected at such times because a portion of the exhaled gas bypasses the scrubber through check valve 74 when the user's ventilation rates exceeds the pumping rate of the ejector. The amount of gas which is bypassed is kept low enough to keep the percentage of carbon dioxide in the inhaled gas within physiologically acceptable limits. For example, during testing of a system of this invention at levels corresponding to very heavy work (a ventilation of 90 liters per minute), the carbon dioxide in the inhaled gas was kept to not more than 3%. When subject to heavy work rates, it is not uncommon with many closed circuit devices to detect carbon dioxide in the inhalation gas. The carbon dioxide is a result of breakthrough of the sorbant canister where a certain percentage of the exhaled gas passes through the canister unscrubbed of its carbon dioxide. In the system of this application, the carbon dioxide results not from breakthrough of the soda lime in the canister, but from bypassing a portion of the gas around the canister when the ventilation rate of the user exceeds the pumping rate of the ejector. With the ejector pump assist and the exhalation and inhalation gas accumulators, the inhalation and exhalation efforts remain uniformly low even at very high breathing rates.

It has been recognized in prior closed circuit breathing apparatus that it is desirable to provide an alarm should the source of makeup oxygen fail. This apparatus also includes such an alarm which includes a valve in the form of a diaphragm 78 which is normally biased towards a valve seat 80 by spring 82. In the design shown in FIG. 1, the alarm valve means is disposed within the branch circuit 44 and will cause the wearer of the mask 12 to sense a higher exhalation resistance when the diaphragm contacts the valve seat 78. However, the diaphragm is normally held away from the seat 80 by means of a low pressure line 84 which is connected to the venturi 52. Thus, during normal operation, the diaphragm 78 will not contact the seat 80. However, in the event that the chlorate candle 50 becomes exhausted, or in the event the venturi 52 or scrubber 38 becomes clogged, there will no longer be a vacuum in the venturi 52 and line 84. This will permit the spring 82 to force the diaphragm 78 against the seat 80, thereby causing increased breathing resistance. In the event that the venturi should become clogged, a bypass passageway 86 is provided to insure continued operation of the system. As can be seen from FIG. 1, when the alarm valve 78, 80 is closed it will prevent exhalation gases from being rebreathed, except for those gases which have passed through the scrubber.

The preferred form of this invention is shown in FIG. 2. This form of the invention corresponds in many respects to the first form and in general the same reference numerals have been utilized to indicated corresponding parts. The principal differences between these two designs, which will be discussed in greater detail below, are: (1) a substantially different form of exhalation gas accumulator is utilized, this being indicated by reference numeral 142; (2) the exhalation gas accumulator is disposed below, rather than above, the inhalation gas accumulator; (3) a redundant system of makeup air, carbon dioxide scrubber, pump and alarm valve means are provided; (4) the carbon dioxide scrubber is disposed downstream of the pump means; (5) the alarm valve means is disposed in a different position; and (6) plenum chambers 148 and 156 are utilized. These differences will now be discussed in greater detail.

In the form of the invention shown in FIG. 2 the exhalation gas accumulator and bypass valves 74 and 76 have been replaced by an accumulator tube assembly 142. In the embodiment illustrated, two concentric tubes are utilized, the smaller accumulator tube 143 being disposed within a larger accumulator tube 145. As indicated by the arrows 147, exhaled gases will flow first down the larger tube 145 and then up the smaller tube 143. Thus, the tube 145 is open at one end to the exhaled gases and the tube 143 is open at another end to the inhalation gas accumulator 46. Therefore, as exhalation gas fills the accumulator, fresh gas is displaced into the inhalation gas accumulator (counterlung). The shape and diameter of the tubes 143 and 145 are such that it is not so small as to cause undue resistance to flow nor so large as to cause significant mixing and diffusion of the exhaled gas with the scrubbed gas which flows down the tube 143 from the inhalation gas accumulator 46. This form of the exhalation gas accumulator has the advantage over the design shown in FIG. 1 in that it is simpler and has fewer parts. Also, as there are no check valves comparable to check valves 74, 76, there is greater assurance that all system gases (with the exception of the gases in the immediate vicinity of the pump 40) will be held at the same pressure. However, the form shown in FIG. 1 has the advantage of minimizing the volume impact of the reservoir because it is contained within the counterlung housing 88.

In the design of FIG. 2, the exhalation gas accumulator is disposed below the inhalation gas accumulator. This permits a valve 149 to be disposed at the bottom of the exhalation gas accumulator 142 for the purpose of removing condensation from the system. The relief valve 66 is now disposed above the plate 60 of the inhalation gas accumulator 46 and a relief gas passageway 168 extends from the exhalation gas passageway 18 to the relief valve permitting gas to be discharged from the exhalation gas passageway 18 when the inhalation gas chamber 46 becomes full. This will occur even when the wearer of the apparatus is not exhaling. Thus, air will be displaced down tube 143, up tube 145 and then by reverse flow through plenum chamber 156 to the exhalation gas passageway 18. Thus, by relieving from the exhalation gas passageway less CO2 need be scrubbed from the system.

The design of FIG. 2 utilizes two chlorate candles 50L, 50R as well as two carbon dioxide scrubber cartridges 38L, 38R. By providing dual cartridges, the system has high reliability due to redundancy. In addition to the two cartridges 50, 38 it is also desirable for simplification of design to utilize two pumps 40L, 40R and two alarm valves 78L, 78R. In operation one of the candles, for example 50L, would first be ignited. The candle will typically be designed for a service life of one half hour and the associated carbon dioxide scrubber cartridge will also have a comparable service life. When the candle 50L becomes exhausted, the alarm valve 78L, 80L will close warning the wearer that it is now time to switch over to the redundant unit 50R, 38R at which time he will then cause the candle 50R to become ignited. If the wearer chooses he can then replace the first set of cartridges 38L, 50L by closing associated valves 101, 103 and 105 through valve operator 107. The valves can be operated in any suitable manner, such as for example a hose coupling type valve which is closed except when coupled.

By disposing the carbon dioxide scrubber cartridge downstream of the candle 50, as shown in FIG. 2, it should be noted that the gas pressure associated with the valves 101, 103 and 105 is at no time below atmospheric permitting the intrusion of noxious gases.

By disposing the alarm valve 78L, 78R and 80L and 80R in an upper plenum chamber 148 (which replaces the branch circuit 48), when the system fails to operate the wearer of the mask will notice increased inhalation effort. It is felt that the wearer of the mask is more likely to respond to increased inhalation effort than to increased exhalation effort. As can be seen from FIG. 2, when the alarm valve 78, 80 is closed it will prevent the rebreathing of exhalation gases, except for those which have passed through the scrubber.

By utilizing a plenum chamber 156, the plumbing is simplified.

While the alarm valve shown in FIGS. 1 and 2 are caused to be maintained in their open position by means of a low pressure line 84, it can be appreciated that under some circumstances it may be desirable to cause the valve to be operated by the pressure from the oxygen generator 50. Such a design is illustrated in FIG. 3 wherein pressure line 171 is interconnected to the discharge of the oxygen generator in any conventional manner, the pressure bearing against one end of a bellows 173 to force valve stem 177 in an upward direction as viewed in the figure. The valve 179 or the upper end of stem 177 bears against spring 181 and in the event that pressure to the chamber 175 about bellows 173 should be lost, this spring 181 will cause the valve 179 to bear down until it contacts valve seat 183. While the valve design in FIG. 3 will operate in a generally satisfactory manner, typically the valve system shown in FIG. 2 would be preferred as it is responsive not only to loss of oxygen pressure but blockage of the venturi 52 and scrubber 38.

While this invention has been described with respect to two embodiments, other variations should be obvious to those having ordinary skill in the art. Thus, while preferred structures in which the principals of this invention have been incorporated are shown and described above, it is to be understood that this invention is not to be limited to the particular details shown and described above, but that, in fact, widely differing means may be employed in the practice of the broader aspects of this invention.

What is claimed is:

1. A single person portable closed circuit breathing apparatus (10) having low breathing resistance at all work rates; said apparatus comprising:

gas circulating circuit means (16) including a mask (12), exhalation passageway means (18), a carbon dioxide absorber (38), and inhalation passageway means (20) which are connected to each other in sequence to provide for gas flow from the mask to the exhalation passageway means, through the carbon dioxide absorber, to the inhalation passageway means, and then back to the mask, pump means (40) in circuit with the carbon dioxide absorber and capable when driven of forcing exhaled gases through the carbon dioxide absorber at a relatively constant volumetric rate, an exhalation gas accumulator means (42, 142) in fluid communication with the exhalation passageway means, and a collapsible inhalation gas accumulator means (46) in fluid communication with the inhalation passageway means and also in fluid communication with the exhalation gas accumulator means so that, the interconnected accumulator means maintain system gases at the same pressure to either side of the carbon dioxide absorber and permit transfer of gases from either the exhalation gas accumulator means or the inhalation gas accumulator means to the other gas accumulator means without excessive mixing of inhalation and exhalation gases, and spring means associated with said inhalation gas accumulator means to place the gas within the gas circulating circuit means at a pressure above ambient; and a source of makeup oxygen (50) connected to the gas-circulating circuit means.

2. The apparatus as set forth in claim 1 wherein bypass passageway means (86) is disposed about the pump means to insure continued operation of the system in the event the pump means should become clogged.

3. The apparatus as set forth in claim 1 wherein the exhalation accumulator means is disposed in juxtapositioned relationship to said inhalation gas accumulator means, and wherein inlet and outlet check valves (74, 76) are provided between the exhalation gas accumulator means and the inhalation gas accumulator means.

4. The apparatus as set forth in claim 1 wherein the pump means is an ejector pump, the source of makeup oxygen being connected to the ejector pump to drive the same, the source of makeup oxygen being capable of delivering oxygen at a relatively constant flow rate.

5. The apparatus as set forth in claim 1 wherein the source of makeup oxygen is a chlorate candle.

6. The apparatus as set forth in claim 1 further characterized by the provision of a housing, the exhalation gas accumulator means and the inhalation gas accumulator means being mounted within said housing.

7. The apparatus as set forth in claim 6 wherein replaceable cartridges are secured to the housing, the carbon dioxide absorber and the source of makeup oxygen being carried within the replaceable cartridges.

8. A single person portable closed circuit breathing apparatus (10) having low breathing resistance at all work rates; said apparatus comprising:

gas circulating circuit means (16) including a mask (12), exhalation passageway means (18), a carbon dioxide absorber (38), and inhalation passageway means (20) which are connected to each other in sequence to provide for gas flow from the mask to the exhalation passageway means, through the carbon dioxide absorber, to the inhalation passageway means, and then back to the mask, pump means (40) in circuit with the carbon dioxide absorber and capable when driven of forcing exhaled gases through the carbon dioxide absorber at a relatively constant volumetric rate, an exhalation gas accumulator means (41, 142) in fluid communication with the exhalation passageway means, and a collapsible inhalation gas accumulator means (46) in fluid communication with the inhalation passageway means, and also in fluid communication with the exhalation gas accumulator means, the exhalation gas accumulator means including tube means (143, 145) open throughout its length at all times and in communication at one end with the exhalation passageway means and in communication at the other end with the inhalation gas accumulator means, the shape and diameter of the tube means being such that it is not so small as to cause undue resistance to the flow of gases nor so large as to cause significant mixing and diffusing of the exhaled gas with the scrubbed gas in the inhalation gas accumulator means, the interconnected accumulator means maintaining system gases at the same pressure to either side of the carbon dioxide absorber; and a source of makeup oxygen connected to the gas circulating means.

9. The apparatus as set forth in claim 8 wherein said tube means includes first and second concentric tubes, the first tube (145) being disposed within the second tube (143), one end of the first tube (145) being connected to the exhalation passageway means, and an adjacent end of the second tube (143) being connected to the inhalation gas accumulator means.

10. The apparatus as set forth in claim 9 wherein the first and second concentric tubes are rigid.

11. The apparatus as set forth in claim 8 wherein the pump means is an ejector pump, the source of makeup oxygen being connected to the ejector pump to drive the same, the source of makeup oxygen being capable of delivering oxygen at a relatively constant rate.

12. The apparatus as set forth in claim 8 further characterized by the provision of a housing, the exhalation gas accumulator means and the inhalation gas accumulator means being mounted within the housing.

13. The apparatus as set forth in claim 12 wherein replaceable cartridges are secured to the housing, the carbon dioxide absorber and the source of makeup oxygen being carried within the replaceable cartridges.

14. The apparatus as set forth in claim 13 wherein said housing is provided with valve means connected between the carbon dioxide absorber and the upstream and downstream sides of said gas circulating circuit means, said valve means being closed when the carbon dioxide absorber is not secured to said housing.

15. A single person portable closed circuit breathing apparatus (10) having low breathing resistance at all work rates; said apparatus comprising:

gas circulating circuit means (16) including exhalation passageway means (18), a carbon dioxide absorber (38), and inhalation passageway means (20) which are connected to each other in sequence to provide for gas flow from the exhalation passageway means through the carbon dioxide absorber to the inhalation passageway means, pump means (40) in circuit with the carbon dioxide absorber and capable when driven of forcing exhaled gases through the carbon dioxide absorber at a relatively constant volumetric rate, exhalation gas accumulator means (42, 142) in fluid communication with the exhalation passageway means, and collapsible inhalation gas accumulator means (46) in fluid communication with the inhalation passageway means, and also in fluid communications with the exhalation gas accumulator means so that the interconnected accumulator means maintain system gases at the same pressure to either side of the carbon dioxide absorber and permit transfer of gases from either the exhalation gas accumulator means or the inhalation gas accumulator means to the other gas accumulator means without excessive mixing of inhalation and exhalation gases;

a source of makeup oxygen (50) connected to the gas-circulating circuit means; and alarm valve means (78, 80) capable of increasing breathing resistance in the event that the pump means, the carbon dioxide absorber, or the source of makeup oxygen becomes inoperative.

16. The apparatus as set forth in claim 15 wherein the pump means is an ejector pump having a venturi, the source of makeup oxygen being connected to the pump in such a manner that it is discharged through the venturi at a relatively constant rate, and the alarm valve means is in fluid communication with said venturi.

17. The apparatus as set forth in claim 6 wherein the alarm valve means is disposed between the inhalation gas accumulator means and the inhalation passageway means and is operable to block passage of gas between the inhalation gas accumulator means and the inhalation passageway means.

18. The apparatus as set forth in claim 6 wherein the alarm valve means is disposed between the exhalation passageway means and the exhalation gas accumulator means.

19. The apparatus as set forth in claim 6 further characterized by the provision of a back-up circuit in parallel connection with the gas circulating circuit means, the back-up circuit being connected at one end to the exhalation passageway means (18) and at the other end to the inhalation passageway means (20), the back-up circuit means including a back-up carbon dioxide absorber and back-up pump means in circuit with the carbon dioxide absorber, said back-up circuit further including a back-up source of make-up oxygen connected to the pump and capable of driving the same.

20. The apparatus as set forth in claim 19 further including second back-up alarm valve means associated with the second back-up pump means.

* * * * *

UNITED STATES PATENT AND TRADEMARK OFFICE

CERTIFICATE OF CORRECTION

PATENT NO. : 4,879,996

DATED : November 14, 1989

INVENTOR(S) : Van H. Harwood, Jr., Jeffrey J. Dosch and Loyal G. Netteland

It is certified that error appears in the above-identified patent and that said Letters Patent is hereby corrected as shown below:

COLUMN 10;

Claim 17, line 44, "claim 6" should be --claim 15--.

Claim 18, line 50, "claim 6" should be --claim 15--.

Claim 19, line 54, "claim 6" should be --claim 15--.

Signed and Sealed this

Thirty-first Day of March, 1992

*Attest:*

HARRY F. MANBECK, JR.

*Attesting Officer*

*Commissioner of Patents and Trademarks*